United States Patent [19]

Liotta

[11] 4,259,084

[45] Mar. 31, 1981

[54] PRETREATMENT OF SOLID, NATURALLY-OCCURRING CARBONACEOUS MATERIAL

[75] Inventor: Ronald Liotta, Clark, N.J.

[73] Assignee: Exxon Research and Engineering Co., Florham Park, N.J.

[21] Appl. No.: 62,809

[22] Filed: Aug. 1, 1979

Related U.S. Application Data

[63] Continuation-in-part of Ser. No. 969,494, Dec. 14, 1978, abandoned.

[51] Int. Cl.[3] ..... C10L 9/02

[52] U.S. Cl. ..... 44/1 R; 44/27; 208/8 LE

[58] Field of Search ..... 44/1 R, 27; 208/8 LE, 208/10

[56] References Cited

U.S. PATENT DOCUMENTS

| | | | |
|---|---|---|---|
| 3,359,197 | 12/1967 | Masciantonio et al. | 208/14 |
| 3,376,212 | 4/1968 | Masciantonio et al. | 208/2 |
| 3,992,432 | 11/1976 | Napier et al. | 260/465.1 |
| 4,059,410 | 11/1977 | Schlosberg et al. | 44/1 R |

OTHER PUBLICATIONS

Ion Pair Extraction in Preparative Org. Chem., Brändström et al., Acta Chem. Scand., p. 2202 (1969).

Chem. Structure and Properties of Coal, Blom et al., vol. 36, Fuel, pp. 135–153, 1957.

Methylation of Coals, Yohe et al., vol. 69, J. ACS, pp. 2644–2648 (1947).

Solubilization of Coals by Reductive Alkylation, Sternberg et al., Fuel, vol. 53, pp. 172–175 (1974).

*Primary Examiner*—Carl F. Dees

*Attorney, Agent, or Firm*—D. W. Collins; Henry E. Naylor

[57] ABSTRACT

Solid, naturally-occurring carbonaceous materials such as coal, lignite, peat and the like are treated by oxygen-alkylation or oxygen-acylation employing a phase transfer reaction under mild conditions. The treated coal may then be liquefied, gasified, pyrolyzed, solubilized or otherwise further processed to obtain useful products therefrom. For example, liquid products derived from coal so treated are more compatible with petroleum products and evidence lower viscosity and boiling range than liquid products not so treated. The solubility of coal bottoms is increased in common organic solvents as compared with coal bottoms derived from untreated coal.

The phase transfer reaction chemically alters phenolic and carboxylic functional substituents. These two very polar functional groups are converted to relatively non-polar ethers and esters, respectively. The O-alkylation or O-acylation is carried out in a binary liquid phase solution (organic and water phases with a solid phase suspended in the medium). A quaternary ammonium or phosphonium salt is reacted with alkali metal or alkaline earth metal base to produce the corresponding quaternary ammonium or phosphonium base. This quaternary base is non-nucleophilic and readily removes the phenolic and carboxylic protons but does little else to the coal structures. After the removal of weakly acidic protons by the base, the phenoxides and carboxylates which are produced then undergo O-alkylation or O-acylation.

36 Claims, No Drawings

PRETREATMENT OF SOLID, NATURALLY-OCCURRING CARBONACEOUS MATERIAL

CROSS-REFERENCE TO RELATED APPLICATIONS

This is a continuation-in-part application of Ser. No. 969,494, filed Dec. 14, 1978 now abandoned.

BACKGROUND OF THE INVENTION

1. Field of the Invention

This invention is directed to improving properties of solid, naturally occurring carbonaceous materials and, in particular, to improving yields and physical characteristics of products derived therefrom.

2. Description of the Prior Art

Much work has been done in recent years to make useful liquids and gases from coal. Various types of liquefaction processes have been developed such as solvent refining, direct hydrogenation with or without a catalyst, catalytic or non-catalytic hydrogenation in the presence of a non-donor solvent and catalytic or non-catalytic liquefaction by the donor solvent method.

Pretreatment processes have been developed, e.g., to increase liquid products from coal liquefaction. Exemplary of such pretreatment processes is U.S. Pat. No. 4,092,235 which discloses pretreatment of coal at the carbon sites by the Friedel-Crafts C-alkylation or C-acylation. The C-alkylation/acylation process destroys the caking properties of caking coals and does not enhance the caking properties of non-caking coals. Other coal conversion processes under extensive investigation include solubilization, gasification and pyrolysis.

SUMMARY OF THE INVENTION

In accordance with the present invention, properties of solid, naturally-occurring carbonaceous materials, such as coal, are improved, by oxygen-alkylation or oxygen-acylation, which method comprises treating the solid carbonaceous material with (a) at least one quaternary base represented by the formula $R_4QOR''$ where each R is the same or different group selected from the group consisting of $C_1$ to about $C_{20}$ alkyl and $C_1$ to about $C_{20}$ aryl; Q is nitrogen or phosphorus; and R'' is selected from the group consisting of hydrogen, $C_1$ to about $C_{10}$ alkyl, aryl, alkylaryl, arylalkyl and acetyl; and (b) at least one compound represented by the formula R'X where R' is a $C_1$ to $C_{20}$ alkyl or acyl group and X is a leaving group selected from the group consisting of halide, sulfate, bisulfate, acetate and stearate, wherein X is attached to a primary or secondary carbon atom.

In a preferred embodiment of the present invention the solid, naturally-occurring carbonaceous material is coal.

By the process of the present invention, the improvement in properties of the carbonaceous material is achieved by oxygen-alkylation or oxygen-acylation. The treated carbonaceous material may then be further processed such as by liquefaction, gasification, pyrolysis, solubilization and the like to produce useful coal products.

DETAILED DESCRIPTION OF THE INVENTION

The procedure that follows is especially useful for the selective alkylation or acylation of bituminous, subbituminous and lignite coals, peats and other solid, naturally-occurring carbonaceous materials employed in various carbonaceous conversion processes. Functionalities containing weakly acidic protons in the carbonaceous material are chemically altered. For example, acidic proton-containing groups such as phenolic and carboxylic which are very polar functional groups are converted to relatively non-polar ethers and esters, respectively. The chemical transformation may be represented as follows:

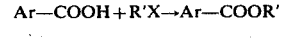

$$Ar—OH + R'X \rightarrow Ar—OR'$$

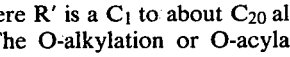

$$Ar—COOH + R'X \rightarrow Ar—COOR'$$

where R' is a $C_1$ to about $C_{20}$ alkyl or acyl group.

The O-alkylation or O-acylation of solid carbonaceous material by reagents which are in liquid solution is greatly influenced by use of a phase transfer reagent. Such a reagent has both a lipophilic and hydrophilic portion and is capable of transferring a basic species, —OR'', from an aqueous phase to either a solid or liquid organic phase, where R'' is as previously defined. The phase transfer reagent may be generated catalytically, in which case the process is termed a phase transfer catalysis, which is a well-known reaction; see, e.g., Vol. 99, Journal of the American Chemical Society, pp. 3903–3909 (1977). Alternatively, the reagent may be generated in a separate step, then used in the alkylation or acylation reaction. If this latter reaction is employed, then the active form of the reagent may be regenerated in a subsequent step. In either case, the overall chemical transformation on the solid carbonaceous material is the same. A generalized mechanistic scheme of this transformation is shown below:

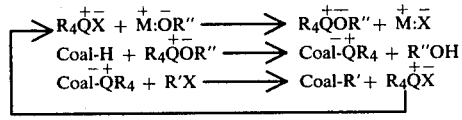

$$R_4\overset{+}{Q}\overset{-}{X} + \overset{+}{M}:\overset{-}{O}R'' \longrightarrow R_4\overset{+}{Q}\overset{-}{O}R'' + \overset{+}{M}:\overset{-}{X}$$

$$\text{Coal-H} + R_4\overset{+}{Q}\overset{-}{O}R'' \longrightarrow \text{Coal-}\overset{-}{O}\overset{+}{Q}R_4 + R''OH$$

$$\text{Coal-}\overset{-}{O}\overset{+}{Q}R_4 + R'X \longrightarrow \text{Coal-}R' + R_4\overset{+}{Q}\overset{-}{X}$$

The phase transfer reagent is preferably a quaternary base represented by the formula $R_4QOR''$ where each R is the same or different group selected from the group consisting of $C_1$ to about $C_{20}$, preferably $C_1$ to $C_6$ alkyl and $C_1$ to about $C_{20}$, preferably $C_1$ to $C_6$ aryl group; Q is nitrogen or phosphorus, preferably nitrogen, and R'' is selected from the group consisting of hydrogen, $C_1$ to about $C_{10}$, preferably $C_1$ to $C_6$ alkyl, aryl, alkylaryl, arylalkyl and acetyl group; more preferably a $C_1$ to $C_4$ alkyl group and most preferably hydrogen. The phase transfer reagent may be generated by reacting the corresponding quaternary salt $R_4QX$ with a metal base MOR'' where X is selected from the group consisting of halide, sulfate, bisulfate, acetate and stearate. Preferred is when X is a halide selected from the group consisting of chlorine, bromine and iodine, more preferably chlorine. M is selected from the group consisting of alkali metals, more preferably sodium and potassium. As shown above, the quaternary base is then reacted with the acidic groups on the coal which in turn is reacted with at least one alkylating or acylating agent represented by the formula R'X wherein R' is selected from the group consisting of $C_1$ to about $C_{20}$ alkyl or acyl group and X is as previously defined, as long as X is attached to a primary or secondary carbon atom. Preferably R' is an inert hydrocarbon, that is, a hydrocarbon group containing only hydrogen and carbon although hydrocarbon groups containing other functionality may also be suitable for use herein, even though less desirable. It will be noted that the acidic proton H (hydrogen atom) is usually located on phenolic groups in higher rank coals and on carboxylic groups for lower rank coals. The acidic proton may also be located to a lesser extent on sulfur, nitrogen, etc.

Phase transfer reagents such as quaternary ammonium base ($R_4NOR''$) are very effective in the O-alkylation and O-acylation of coal and other solid, naturally-occurring carbonaceous materials. These O-alkylation and O-acylation reactions are successful because the —OR" portion of the molecule is soluble in an organic medium. When this base is present in such a medium, it is not solvated by water or other very polar molecules. As an unsolvated entity, it can react as a very efficient proton transfer reagent. For example, $$(\text{coal})\text{—OH}+\bar{O}R''\rightarrow(\text{coal})\text{—O}+R''\bar{O}H$$

This unsolvated base (also known as a "naked hydroxide" when R" is hydrogen) can have a wide variety of counterions. Although the counterion may be quaternary ammonium or phosphonium species as previously discussed, other examples of counterions useful in the practice of the invention include "crown ether" complexes of a salt containing the OR" anion and clathrate compounds complexed with a salt containing the OR" anion. Salts represented by MOR", where M is as given above, when complexed with crown ethers, for example, have been previously demonstrated to evidence a reactivity similar to that found for $R_4QOR''$ compounds.

In one embodiment of the process of the invention, a two-phase solid/liquid system comprising the particular solid carbonaceous material in liquid suspension is formed. The carbonaceous material is generally ground to a finely divided state and contains particles less than about ¼ inch in size, preferably less than about 8 mesh NBS in size, more preferably less than about 80 mesh. The smaller particles, of course, have greater surface area and thus alkylation or acylation will proceed at a faster rate. Consequently, it is desirable to expose as much surface area of the solid as possible, without losing solid as dust or fines or as the economics of grinding may dictate. Thus, particle sizes of greater than about 325 mesh are preferred.

Although not necessary, a solvent may be added if desired. The solvent may be used to dissolve alkylated or acylated carbonaceous product or to dissolve alkylating or acylating agent (especially if the agent is a solid and is comparatively insoluble in water). The solvent may also be used to provide for more efficient mixing. Many of the common organic solvents may be employed in any reasonable amount, depending upon the desired result.

Inasmuch as there are solid carbonaceous particles which never dissolve in the course of the reaction, there may be some concern as to the extent of the reaction on these particles. To verify the complete extent of the reaction, these particles were collected and worked up separately on numerous runs with a wide variety of alkylating agents as well as coals. Infrared spectral analysis of this insoluble portion of the coal reaction mixture showed that in every case, substantially complete alkylation of the hydroxyl group had occurred. This is evidence that the phase transfer reagent must have penetrated the solid coal structure and that the resulting organic salt of the coal must have reacted with the alkylating agent to produce the observed product. Thus, the etherification and esterification reactions are not merely taking place on the surface of the carbonaceous material, but throughout the structure as well.

The phase transfer reagent that is used must dissolve in or be suspended in both phases so that it has intimate contact with both the organic and aqueous phases. During the course of the reaction, the phase transfer reagent will partition itself into both of these phases. Quaternary bases are the preferred class of compounds useful as phase transfer reagents in the practice of the invention and are given by the formula $R_4QOR''$, as previously defined. The lower number of carbon atoms comprising each R group is preferred, since such compounds are water soluble and can be removed from the alkylated or acylated carbonaceous material by simple water washing. The R groups may be the same or different. Examples of some preferred R groups include methyl, butyl, phenyl and hexadecyl.

Examples of quaternary bases useful in the practice of the invention include the following:

1. Tetrabutylammonium hydroxide, $(C_4H_9)_4NOH$
2. Benzylhexadecyldimethylammonium hydroxide, $(C_6H_5CH_2)(C_{16}H_{33})(CH_3)_2NOH$
3. Tetrabutylphosphonium hydroxide, $(C_4H_9)_4POH$
4. ADOGEN 464, $(C_8\text{–}C_{10})_4NOH$ (ADOGEN 464 is a trademark of Aldrich Chemical Co., Metuchen, N.J.)

The metal base used to convert the quaternary salt to the corresponding base is an alkali metal or alkaline earth metal base such as NaOH, KOH, $Ca(OH)_2$ or $NaOCH_3$. The use of an alkoxyde, for example, permits use of the corresponding alcohol in place of water, which may provide an advantage in process flexibility.

In chosing the alkylating and acylating reagent, two considerations must be weighed. First, it is desired to add longer chains to the solid carbonaceous material which render the product more petroleum-like, therefore, more soluble in organic solvents and more compatible with petroleum liquids. Second, shorter chain materials are less expensive and still improve solubility.

In the case of O-alkylation, the carbon to which the leaving group is attached may be either a primary or secondary carbon atom. Primary carbon halides have been found to react faster than the corresponding halides in a phase transfer catalyzed reaction on carbonaceous materials and are, accordingly, preferred. While the balance of the carbon-bearing functional group may, in general, contain other moieties, such as heteroatoms, aryl groups and the like, bonding of the carbon-bearing functional group to the phenolic or carboxylic oxygen of the carbonaceous material is through either an $sp^3$ hybridized carbon atom (alkylation) or an $sp^2$ hybridized carbon atom (acylation). Further, a mixture of alkylating or acylating agents or a mixture of both may advantageously be employed. Such mixtures are likely to be generated in coal-treating plants in other processing steps and thus provide a ready source of alkylating and/or acylating agents. Examples of alkylating and acylating agents useful in the practice of the invention include ethyl iodide, isopropyl chloride, dimethyl sulfate, and benzyl bromide and acetyl chloride.

While alkylating and/or acylating agents are employed in the practice of the invention, alkylating agents are preferred for the following reasons. First, alkylating agents are readily prepared from their hydrocarbon precursors. For example, alkyl halides may be easily prepared by free radical halogenation of alkanes, which is a well known process. When a system containing more than one alkylating or acylating agent is used, the hydrocarbon precursor is preferably a product stream of a certain cut derived from such process as coal and petroleum processing and the like. This stream may contain minor amounts of components having various degrees of unsaturation which are also suitable for reacting with the phenolic and carboxylic groups herein as long as X is attached to an alkyl or saturated carbon atom in the resulting alkylating or acylating agent. Second, acylating reagents are susceptible to hydrolysis. Since water is ever present in coal and other solid carbonaceous material and is employed in the inventive process, some loss of acylating agent may occur by hydrolysis. In contrast, alkylating reagents do not evidence the same susceptibility to hydrolysis.

If the O-alkylation or O-acylation is carried out by a catalytic process, then the quaternary salt, metal base and alkylating or acylating agent are mixed directly with an aqueous slurry of the solid carbonaceous material. The quaternary salt catalyst may be present in small amounts, typically about 0.05 to 10 wt.% of the amount of carbonaceous material used; however, greater amounts may also be employed. The metal base and alkylating or acylating agent must be present in at least stoichiometric quantities relative to the number of acidic sites (phenolic, carboxylic, etc.) on the carbonaceous material, but preferably an excess of each is used to drive the reaction to completion. Advantageously, a two-fold excess of metal base and alkylating or acylating agent is employed; however, a greater excess may be employed. After the reaction, the excess quaternary base and quaternary salt catalyst may be removed from the carbonaceous material by simple water washing for recycling. Excess metal base will also be extracted into the water wash and may be reused. Excess alkylating or acylating agent may be conveniently removed from the treated carbonaceous material by fractional distillation or by solvent and may be reused.

To cap off all acidic protons in a typical solid carbonaceous material employed in the catalytic process, less than about 5 days are required for 100% conversion, employing only a slight excess of alkylating or acylating agent on 80/100 mesh carbonaceous material under atmospheric pressure and ambient temperature. A greater excess of alkylating or acylating agent will reduce the reaction time considerably.

A faster alkylation or acylation reaction may be obtained in a number of ways, one of which is to add the phase transfer reagent ($R_4QOR''$) directly to the carbonaceous material rather than to form this reagent in situ with the reaction in which the carbonaceous material is alkylated or acylated. When this is done, substantially complete conversion of all phenolic and carboxylic groups is achieved in a matter of minutes. The amount of quaternary base added ranges from about stoichiometric proportions to about 10 times the total number of acidic sites on the carbonaceous material which are capable of undergoing alkylation or acylation. As before, the quaternary salt that is generated in the alkylation or acylation step may be recovered and recycled by treating it with metal base to regenerate the quaternary base. By employing this two-step process, there is no contact between metal base and the carbonaceous material, and the reaction is essentially complete in about one hour.

As an example, in 10 g. of Illinois No. 6 coal, there are 35 mmoles of Ar—OH groups. An excess of a quaternary hydroxide along with an excess of an alkylating agent (about 4 to 5 times each) results in substantially complete alkylation in less than one hour at ambient conditions. In contrast, in the phase transfer catalyzed reaction, there is metal base present so that the alkylation (or acylation) must be carried out in an inert atmosphere, such as nitrogen, to avoid oxidation of the coal. In the case of the non-catalyzed process in which the formation of transfer reagent is kept separate from the alkylating or acylating reaction, the rate of oxidation of the coal is slow enough and is not competitive with the alkylation or acylation reaction. Therefore, another advantage of this non-catalyzed process is that the use of an inert atmosphere such as nitrogen is not required.

The temperature at which the reaction is carried out may range from ambient to the boiling point of the materials used. Increased temperature will, of course, speed up the reaction rate.

The reaction mixture may be stirred or agitated or mixed in some fashion to increase the interface or surface area between the phases, since there can be aqueous, organic liquid and solid carbonaceous material phases present.

The reaction is carried out at ambient pressure, although low to moderate pressures (about 2 to 20 atmospheres) may be employed along with heating to increase the reaction rate.

Once the reagents and solvents if any are removed from the alkylated or acylated carbonaceous material, infrared analysis may be conveniently used to demonstrate that all the hydroxyl groups have been alkylated or acylated. If the added alkyl or acyl group is IR-active, then the appearance of the appropriate infrared frequency is observed. Other well-known analytical methods may also be employed if desired. The ultimate analysis of percent C, H, N, S and O is altered in a fashion which is consistent with the expected change due to the added alkyl or acyl substituent. Specifically, the increase in the H/C ratio of O-methylated Illinois No. 6 coal indicates that 4.5 methyl groups per 100 carbon atoms are added to the coal. The H/C ratio of the untreated illinois No. 6 coal is 0.84 and the H/C ratio after O-methylation by the process of the invention is 0.89.

The thermogravimetric analysis of the O-methylated coal shows a significant increase in volatile organic content over the untreated coal (38% versus 32%). The solvent extractability of the carbonaceous material is greatly increased after it is O-alkylated or O-acylated. For example, Illinois No. 6 coal becomes more soluble in common organic solvents after it is oxygen-methylated, as shown in Table I below:

TABLE I

| | MAXIMUM SOLUBILITY (at 1 atm) | | |
|---|---|---|---|
| | Toluene | Tetrahydrofuran | Pyridine |
| Illinois #6 Coal | 3% | 17% | 27% |
| O-Methylated Illinois #6 Coal | 7% | 22% | 34% |

Liquids which are derived by solvent extraction of carbonaceous material treated in accordance with the invention evidence both improved quality and increased quantity over coal liquids derived from non-treated coal. For example, O-methylation of Illinois No.

6 coal results in 34% solubility in pyridine (as compared to 27% for non-O-methylated coal; see Table I). The soluble liquids from the O-alkylated or O-acylated carbonaceous materials have higher H/C ratio than the soluble products from untreated carbonaceous materials.

Lower rank coals having little or no caking properties will manifest considerably improved caking properties upon pyrolysis. Further, as a consequence of employing the process of the invention, pyrolysis of coal treated in accordance with the invention yields liquids and gases having improved stability and compatibility with petroleum products, as well as higher hydrogen content over coals not so treated.

Upon liquefaction, the viscosity and boiling range of liquefaction distillates are lowered, the yield of the distillates is increased and the liquids are more compatible with petroleum liquids. Liquefaction bottoms are also rendered more compatible with petroleum liquids and the solubility of the liquefaction bottoms in common organic solvents is increased.

Similarly, products from other processes on solid carbonaceous material treated in accordance with the invention evidence improved properties and compatibility with petroleum products.

EXAMPLES

EXAMPLE 1

Phase Transfer Non-Catalyzed Alkylation

Rawhide subbituminous coal was treated as follows:

A slurry of 30.8 g. Rawhide coal (−80 mesh) and 300 mmoles (free base) of tetrabutylammonium hydroxide (75% in aqueous solution) were mixed together at ambient temperature and 1 atm. pressure for a few minutes. Tetrahydrofuran (200 ml) and 500 mmoles of n-heptyliodide was then added and the reaction mixture was stirred for nearly three hours. The colorless water layer was then separated and fresh water added to wash out any residual quaternary salt from the organic phase, which contained the O-alkylated coal. The washing was continued until the pH of the wash water was neutral and no precipitate formed when silver nitrate was added to the wash water. (A byproduct of the alkylation was tetrabutylammonium iodide which reacted with the silver nitrate to give a precipitate of AgI). The excess heptyliodide, water and THF were removed by vacuum distillation at 100°-110° C. The alkylated coal was then analyzed. Infrared analysis revealed substantially complete elimination of the hydroxyl band (3100-3500 $cm^{-1}$), as well as incorporation of the alkyl ether functionality (1000-1200 $cm^{-1}$) and incorporation of the ester carbonyl functionality (1700-1735 $cm^{-1}$).

EXAMPLES 2-7

Phase Transfer Non-Catalyzed Alkylation

The following runs were made, employing the procedure set forth in Example 1. In each reaction, the quaternary base was tetrabutylammonium hydroxide. The base was present in at least stoichiometric amount of the number of acidic protons on the coal sample in the case of Rawhide and 2:1 in the case of Illinois No. 6.

TABLE II

PHASE TRANSFER NON-CATALYZED REACTIONS

| Example | Coal(1) | R'X(2) | Reaction Time/hr. |
|---|---|---|---|
| 2 | Illinois #6 (80/100) | $CH_3I$, 200% | 1 |
| 3 | Illinois #6 (−80) | $C_4H_9I$, 200% | 3 |
| 4 | Illinois #6 (80/100) | $C_7H_{15}I$, 200% | 3 |
| 5 | Rawhide (80/100) | $CH_3I$, 200% | 1 |
| 6 | Rawhide (80/100) | $C_4H_9I$, 200% | 3 |
| 7 | Rawhide (80/100) | $C_7H_{15}I$, 200% | 3 |

Notes:
(1)Mesh size is indicated in parenthesis
(2)Weight percent relative to coal.

EXAMPLE 8

Phase transfer Catalyzed Alkylation

Illinois No. 6 coal was treated as follows:

20 grams of illinois No. 6 coal (80/100 mesh), 50 ml of a 50% aqueous NaOH solution, 150 ml of toluene, 70 mmoles of $CH_3I$ and 1 g. of tetrabutylammonium chloride were mixed together under a nitrogen atmosphere (the order of addition was not important). After five days, the aqueous layer was separated and the organic phase washed with water until the unreacted sodium hydroxide and catalyst were extracted out of the toluene. The toluene, water and excess iodomethane were removed under vacuum at 100° C. The O-alkylated coal was then analyzed. infrared analysis revealed essentially complete elimination of the hydroxyl band (3100-3500 $cm^{-1}$), as well as incorporation of the alkyl ether functionality (1000-1200 $cm^{-1}$) and incorporation of the ester carbonyl functionality (1700-1735 $cm^{-1}$).

EXAMPLES 9-35

Phase Transfer Catalyzed Alkylation

The following runs were made, employing the procedure set forth in Example 8.

TABLE III

PHASE TRANSFER CATALYZED REACTIONS

| Example | Coal(2) | Solvent | Catalyst(2) | Caustic(3) | R'X(4) |
|---|---|---|---|---|---|
| 9 | Ill. #6 (−300) | Toluene | B, 10% | KOH, 50% | $CH_3I$, 700% |
| 10 | Il, #6 (−300) | Toluene | B, 10% | KOH, 50% | $C_2H_5I$, 500% |
| 11 | Ill. #6 (−100) | Toluene | B, 10% | KOH, 50% | $CH_3I$, 680% |
| 12 | Ill. #6 (−100) | Toluene | B, 10% | NaOH, 50% | $C_7H_{15}I$, 414% |
| 13 | Ill. #6 (−100) | Toluene | B, 10% | NaOH, 50% | Allylbromide, 420% |
| 14 | Wyodak (−100) | Toluene | B, 10% | NaOH, 50% | Allylbromide, 420% |
| 15 | Wyodak (−100) | Toluene | B, 10% | NaOH, 50% | $CH_3I$, 680% |
| 16 | Wyodak (−100) | Toluene | B, 10% | NaOH, 50% | Crotylbromide, 500% |
| 17 | Wyodak (−100) | Toluene | B, 10% | NaOH, 50% | $C_7H_{15}$, 414% |
| 18 | Wyodak (−100) | Toluene | B, 10% | NaOH, 50% | Cinnamylbromide, 500% |
| 19 | Ill. #6 (−100) | Toluene | B, 10% | NaOD, 40% | $CD_3I$, 137% |
| 20 | Ill. #6 (−100) | Toluene | B, 10% | NaOH, 50% | Propargylbromide, 375% |
| 21 | Wyodak (−100) | Toluene | B, 10% | NaOH, 50% | Propargylbromide, 624% |
| 22 | Wyodak (−100) | Toluene | B, 5% | NaOH, 50% | $(CH_3)_2SO_4$, 478% |
| 23 | Texas Lignite (−100) | Toluene | B, 10% | NaOH, 50% | Allylbromide, 450% |
| 24 | Ill. #6 (−100) | Toluene | B, 3.3% | NaOH, 12% | $C_4H_9Cl$, 427% |

TABLE III-continued

PHASE TRANSFER CATALYZED REACTIONS

| Example | Coal[2] | Solvent | Catalyst[2] | Caustic[3] | R'X[4] |
|---|---|---|---|---|---|
| 25 | Ill. #6 (−100) | Toluene | B, 10% | NaOH, 20% | $C_3H_7I$, 388% |
| 26 | Ill. #6 (−80) | Xylenes | B, 10% | NaOH, 20% | 1-bromo-2-methyl, propane, 351% |
| 27 | Ill. #6 (−80) | Xylenes | A, 10% | NaOH, 20% | 2-iodopropane, 461% |
| 28 | Ill. #6 (−80) | Xylenes | T, 10% | NaOH, 12% | $CH_3I$, 540% |
| 29 | Ill. #6 (−80) | Toluene | T, 10% | NaOH, 12% | $CH_3I$, 50% |
| 30 | Ill. #6 (−80) | Toluene | T, 5.8% | NaOH, 12% | $CD_3I$, 72% |
| 31 | Ill. #6 (80/100) | Toluene | T, 5% | NaOH, 20% | $CD_3I$, 50% |
| 32 | Ill. #6 (80/100) | Toluene | T, 5% | NaOH, 20% | $C_4H_9I$, 100% |
| 33 | Ill. #6 (80/100) | THF | T, 5% | NaOH, 20% | $C_4H_9I$, 100% |
| 34 | Ill. #6 (300/325) | Toluene | T, 5% | NaOH, 20% | $C_4H_9I$, 100% |
| 35 | Ill. #6 (300/325) | THF | T, 5% | NaOH, 20% | $C_4H_9I$, 100% |

Notes:
[1]Mesh size is indicated in parentheses.
[2]B is benzylhexadecyldimethylammonium chloride, A is ADOGEN 464 and T is tetrabutylammonium iodide; weight percent is relative to coal.
[3]Weight percent of caustic in water.
[4]Weight percent relative to coal.

What is claimed is:

1. A method for improving properties of coal, by oxygen-alkylation or oxygen-acylation, which method comprises contacting the coal with a solution comprising:
   (a) at least one quaternary base represented by the formula $R_4QOR''$ where each R is the same or different group selected from the group consisting of $C_1$ to about $C_{20}$ alkyl and $C_1$ to about $C_{20}$ aryl; Q is nitrogen or phosphorus; and R'' is selected from the group consisting of hydrogen, $C_1$ to about $C_{10}$ alkyl, aryl, alkylaryl, arylalkyl and acetyl; and
   (b) at least one compound represented by the formula R'X where R' is a $C_1$ to $C_{20}$ alkyl or acyl group and X is selected from the group consisting of halides, sulfates, bisulfates, acetates and stearates; wherein X is attached to a primary or secondary carbon atom.

2. The method of claim 1 wherein R'' is a $C_1$ to $C_4$ alkyl group or hydrogen.

3. The method of claim 2 wherein R'' is hydrogen.

4. The method of claim 1 wherein Q is nitrogen.

5. The method of claim 3 wherein Q is nitrogen.

6. The method of claim 1 wherein each R is the same or different $C_1$ to $C_6$ alkyl group.

7. The method of claim 5 wherein each R is the same or different $C_1$ to $C_6$ alkyl group.

8. The method of claim 1 wherein R' is a $C_1$ to $C_4$ inert hydrocarbon group.

9. The method of claim 7 wherein R' is a $C_1$ to $C_4$ inert hydrocarbon.

10. The method of claim 1 wherein X is selected from the group consisting of chlorine, bromine and iodine.

11. The method of claim 9 wherein X is selected from the group consisting of chlorine, bromine and iodine.

12. The method of claim 11 wherein X is chlorine and R' is a methyl group.

13. The method of claim 1 wherein the amount of quaternary base ranges from about a stoichiometric amount to about 10 times the total number of acidic sites on the coal.

14. The method of claim 12 wherein the amount of quaternary base ranges from about a stoichiometric amount to about 10 times the total number of acidic sites on the coal.

15. The method of claim 1 wherein R'X is present in at least a stoichiometric amount relative to the number of acidic sites on the coal.

16. The method of claim 14 wherein R'X is present in at least stoichiometric amounts relative to the number of acidic sites on the coal.

17. The method of claim 1 wherein a quaternary salt represented by the formula $R_4QX$ is reacted with an alkali or alkaline earth metal base represented by the formula MOR'' to form the corresponding quaternary base, wherein M is an alkali or alkaline earth metal.

18. The method of claim 16 wherein a quaternary salt represented by the formula $R_4QX$ is reacted with an alkali or alkaline earth metal base represented by the formula MOR'' to form the corresponding quaternary base, wherein M is an alkali or alkaline earth metal.

19. A method for improving properties of solid, naturally-occurring carbonaceous material having acidic sites which method comprises contacting the carbonaceous material with a solution comprising:
   (a) at least one quaternary base represented by the formula $R_4QOR''$ where each R is the same or different group selected from the group consisting of $C_1$ to about $C_{20}$ alkyl and $C_1$ to about $C_{20}$ aryl; Q is nitrogen or phosphorus; and R'' is selected from the group consisting of hydrogen, $C_1$ to about $C_{10}$ alkyl, aryl, alkylaryl, arylalkyl and acetyl; and
   (b) at least one compound represented by the formula R'X where R' is a $C_1$ to $C_{20}$ alkyl or acyl group and X is selected from the group consisting of halides, sulfates, bisulfates, acetates, and stearates; wherein X is attached to a primary or secondary carbon atom.

20. The method of claim 19 wherein R'' is a $C_1$ to $C_4$ alkyl group or hydrogen.

21. The method of claim 20 wherein R'' is hydrogen.

22. The method of claim 19 wherein Q is nitrogen.

23. The method of claim 21 wherein Q is nitrogen.

24. The method of claim 19 wherein each R is the same or different $C_1$ to $C_6$ alkyl group.

25. The method of claim 23 wherein each R is the same or different $C_1$ to $C_6$ alkyl group.

26. The method of claim 19 wherein R' is a $C_1$ to $C_4$ inert hydrocarbon group.

27. The method of claim 25 wherein R' is a $C_1$ to $C_4$ inert hydrocarbon group.

28. The method of claim 19 wherein X is a halide selected from the group consisting of chlorine, bromine and iodine.

29. The method of claim 27 wherein X is a halide selected from the group consisting of chlorine, bromine and iodine.

30. The method of claim 29 wherein X is chlorine and R′ is a methyl group.

31. The method of claim 19 wherein the amount of quaternary base ranges from about a stoichiometric amount to about 10 times the total number of acidic sites on the carbonaceous material.

32. The method of claim 30 wherein the amount of quaternary base ranges from about a stoichiometric amount to about 10 times the total number of acidic sites on the carbonaceous material.

33. The method of claim 19 wherein R′X is present in at least a stoichiometric amount relative to the number of acidic sites on the carbonaceous material.

34. The method of claim 32 wherein R′X is present in at least a stoichiometric amount relative to the number of acidic sites on the carbonaceous material.

35. The method of claim 19 wherein a quaternary salt represented by the formula $R_4QX$ is reacted with an alkali or alkaline earth metal base represented by the formula MOR″ to form the corresponding quaternary base, wherein M is an alkali or alkaline earth metal.

36. The method of claim 34 wherein a quaternary salt represented by the formula $R_4QX$ is reacted with an alkali or alkaline earth metal base represented by the formula MOR″ to form the corresponding quaternary base, wherein M is an alkali or alkaline earth metal.

* * * * *